United States Patent [19]

Leonardo et al.

[11] 3,998,372

[45] Dec. 21, 1976

[54] ADAPTOR FOR POWDER ACTUATED TOOL OR SIMILAR ITEM

[75] Inventors: Ignazio Leonardo, Mountainside; Michael Faruolo, Elizabeth, both of N.J.

[73] Assignee: General Cable Corporation, Greenwich, Conn.

[22] Filed: Sept. 24, 1975

[21] Appl. No.: 616,510

[52] U.S. Cl. ..... 227/9; 227/149

[51] Int. Cl.[2] ..... B25C 7/00

[58] Field of Search ..... 227/8, 9, 10, 11, 18, 227/147, 149

[56] References Cited

UNITED STATES PATENTS

| | | | |
|---|---|---|---|
| 2,673,980 | 4/1954 | Ballachey et al. | 227/9 |
| 2,806,218 | 9/1957 | Henning et al. | 227/11 |
| 2,863,149 | 12/1958 | Kopf et al. | 227/11 |
| 3,623,647 | 11/1971 | Steinberg | 227/18 |
| 3,632,033 | 1/1972 | Schmidt | 227/18 |
| R23,786 | 2/1954 | Baisch | 227/11 |

*Primary Examiner*—Granville Y. Custer, Jr.
*Attorney, Agent, or Firm*—Hopgood, Calimafde

[57] ABSTRACT

Power-operated tools require an adaptor for holding in place a clip while the tool projects a fastener through the clip to fasten it to a ceiling or other structure. This improved adaptor is held on the barrel of the tool by a connection that permits the clip or the tool to be rotated into the most advantageous position, and the adaptor has a simple and easily manipulated retainer for holding the clip.

11 Claims, 5 Drawing Figures

ADAPTOR FOR POWDER ACTUATED TOOL OR SIMILAR ITEM

BACKGROUND AND SUMMARY OF THE INVENTION

This invention relates to tools that are operated by firing a blank cartridge behind a piston which forces a pin or nail from the muzzle end of the tool into and through a clip which is held against a ceiling, wall, or other structure into which the pin or nail is to be driven. It will be described in connection with a powder tool but can be used with other tools such as pneumatic tools. The terms "pin" and "fastener" will be used herein in a generic sense to indicate a fastening element which is projected from the tool through a clip or other structure which is to be fastened to an adjacent structure by the pin.

The term "clip" is also used herein in a generic sense to indicate any structure member which is fastened to an adjacent structure for the purpose of providing a connector for holding panels or other elements connected to the structure to which the clip is secured. In the illustrated embodiment of the invention, the clip will be shown as an angle section with one leg for connection by the pin to a permanent structure and another leg extending transversely of the first leg and having an opening therein for receiving connecting means for holding the panel or other structure which is connected with the fixed structure to which the clip has been pinned by the percussion tool.

An important consideration in the use of such percussion tools is the holding of the clip in place against the structure to which it is to be connected. This is done by detachably connecting the clip to the muzzle end of the tool so that the clip can be held in place by the tool. This invention provides an improved adaptor on the muzzle end of the tool for holding the clip.

The adaptor is attached to the muzzle of the tool by a connection that permits rotation of the adaptor in either direction about an axis coincident with the axis of the muzzle of the tool. The clip is held in a fixed, but releasable, position with respect to the adaptor.

In the operation of the invention the adaptor is pressed into position to locate the clip at the desired position and orientation; and the tool can then be rotated any position which makes its operation most convenient.

The releasable holder for securing the clip to the adaptor is held against the clip by spring pressure and can be moved back to receive successive clips by a simple, manually operated lever.

Other objects, features and advantages of the invention will appear or be pointed out as the description proceeds.

BRIEF DESCRIPTION OF DRAWING

In the drawing, forming a part hereof, in which like reference characters indicate corresponding parts in all the views.

DESCRIPTION OF PREFERRED EMBODIMENT

Figure 1:
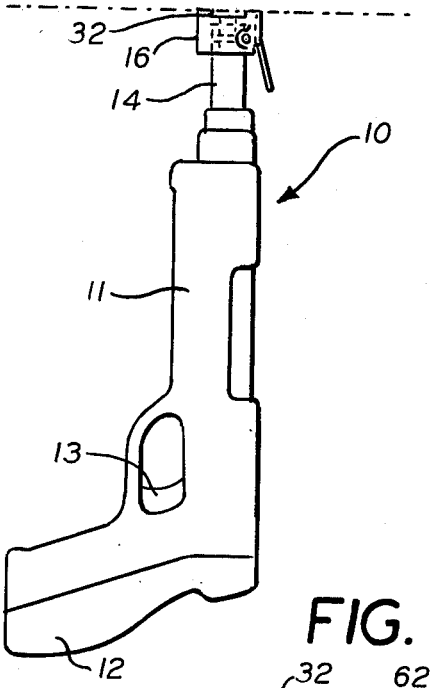
FIG. 1 is a side elevation of a percussion tool equipped with the adaptor of this invention.

FIG. 1 shows a percussion tool 10 which has a body portion 11, a grip portion 12, a trigger 13 and a muzzle 14. The muzzle 14 is fixed with respect to the body portion 11 and does not rotate except as a unit with the entire tool 10. An adaptor 16 is connected to the upper end of the muzzle 10 and is rotatable about the axis of the muzzle in either direction without restraint.

Figure 4:
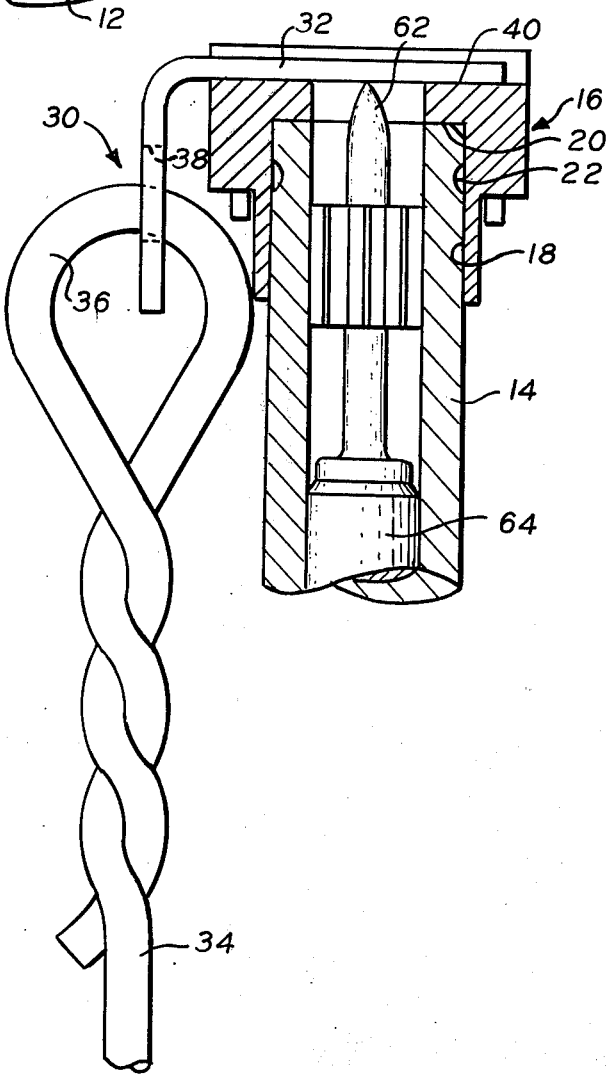
FIG. 4 is a sectional view taken on the line 4—4 of FIG. 3 and showing the clip assembly connected with the adaptor.

The muzzle 14 extends into a socket 18 in the lower end of the adaptor 16 and bottoms against an end wall 200 of the socket 18, as shown in FIG. 4.

Figure 5:
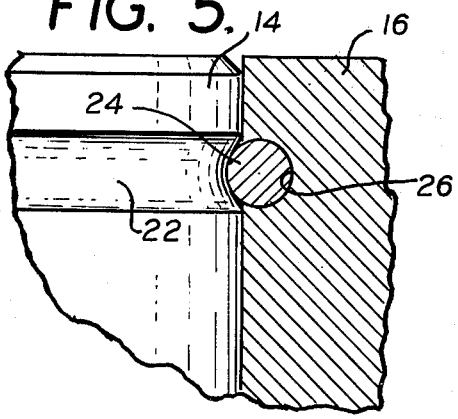
FIG. 5 is a greatly enlarged sectional view taken on the line 5—5 of FIG. 2 but showing the muzzle of the tool in elevation.

There is a circumferential groove 22 in the outside surface of the muzzle 14, as shown in FIGS. 4 and 5. There is a shaft 24 extending through the adaptor 16 in such a position as to engage the groove 22 as shown in FIG. 5. An opening 26 through which the shaft 24 extends has substantially the same diameter as the shaft 24, and the muzzle groove 22 has a radius of curvature substantially equal to the radius of the shaft 24. Thus the shaft 24 holds the adaptor 16 against endwise movement with respect to the muzzle 14, while at the same time leaving the adaptor 16 free to rotate on the muzzle 14.

FIG. 4 shows a clip assembly 30 including a clip 32 and a wire 34 which is connected with the clip by a loop 36 at the upper end of the wire extending through an opening 38 in the clip 32.

Figure 2:
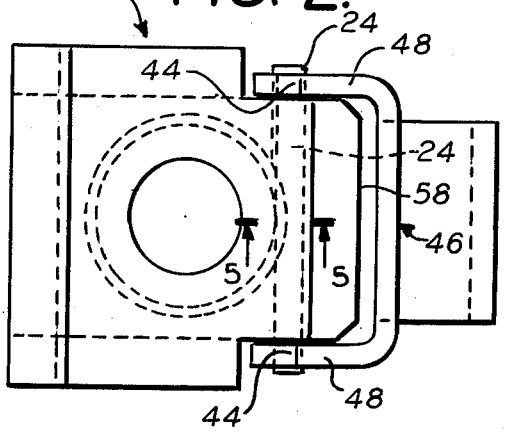
FIG. 2 is a greatly enlarged, top plan view of the adaptor shown in FIG. 1.

The clip rests on a depressed surface 40 at the top of the adaptor; and the clip is held against a wall 42 by tabs 44 which are parts of a U-shaped frame 46. (FIGS. 2 & 3)

The U-shaped frame 46 has extensions 48 which project across faces of the adaptor 16 at opposite ends of the shaft 24. The shaft 24 projects through the extensions 48 and provides bearings on which the U-shaped frame 46 has angular movement with respect to the adaptor 16.

Figure 3:
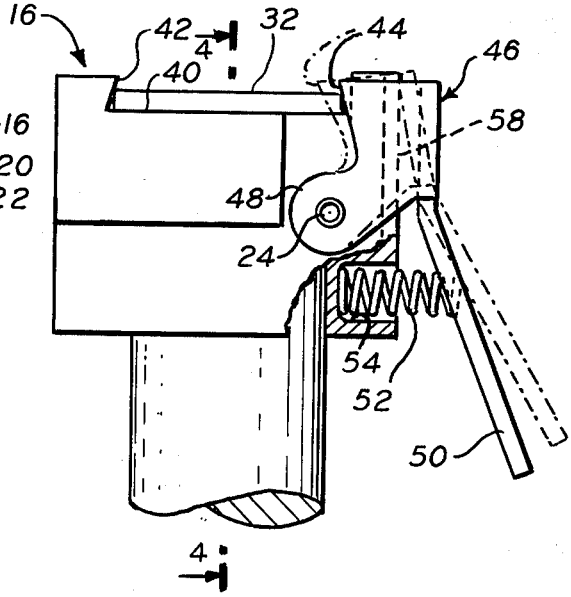
FIG. 3 is a side view, partly broken away and in section, of the adaptor shown in FIG. 2.

An actuator tab 50 extends downward from the U-shaped frame 46 (FIG. 3). A helical compression spring 52 has one end extending into a socket 54 in the adaptor 16; and the other end of the spring 52 contacts with the actuator tab 50 to rock the tab 50 and the U-shaped frame 46 in a counter clockwise direction around the shaft 24. This moves the tabs 44 into contact with the clip 32 if there is any clip on the surface 40 of the adaptor. The pressure of the spring 52 holds the clip 32 against the wall 42 and thereby retains the clip 32 in position on the adaptor.

If there is no clip 32 on the adaptor, the portion of the U-shaped frame 46 between the extensions 48 comes into contact with a surface 58 (FIGS. 2 and 3) of the adaptor as shown in dotted lines in FIG. 3. This limited movement of the U-shaped frame 46 and actuator tab 50 prevents the spring 52 from coming out of the socket 54.

The U-shaped frame 46 and the actuator tab 50 are an integral structure and may be a one piece stamping. Together they comprise a lever, a portion of which bears against one edge of the clip 32 to hold the clip in position on the adaptor 16. This lever is actually a part of the adaptor 16; and it is rocked clockwise by manual pressure against the actuator tab 50 to move the tabs 44 away from the wall 42 whenever a new clip 32 is to be inserted in the adaptor 16.

The confronting surfaces of the wall 42 and the tabs 44 slope toward one another as they extend upward and this provides in effect a tapered channel for holding the clip 32 down against the surface 40 on which it rests. The taper is at a small angle, however, so that when the tool operates, the clip 32 can be projected upwardly and the U-shaped frame 46 rocks clockwise about the shaft 24 to release the clip 32 from the wall 42 and tabs 44.

FIG. 4 shows the clip 32 resting on the surface 40 and extending across the end of the muzzle 14 above a pin 62 by which the clip 32 is to be secured to a ceiling or other structure. A piston 64, located in the muzzle 14 drives the pin 62 from the muzzle 14 when the cartridge in the tool is fired. Such percussion tools are well known and the operating mechanism for the tool forms no part of the present invention.

When the tool is in use, the top surface of the adaptor 16 is brought into contact with the ceiling, or other structure, to which the clip 32 is to be secured. The clip 32 is, therefore, spaced from the ceiling or other structure by a distance which is equal to only the extra height of the wall 42 above the top surface of the clip 32. The clip is thus attached to the ceiling at the location where the clip is held by the adaptor prior to the firing of the tool.

The preferred embodiment of the invention has been described, but changes and modifications can be made and some features can be used in different combinations without departing from the invention as defined in the claims.

What is claimed is:

1. An adaptor for a percussion tool that has a barrel from which a pin is driven into a surface adjacent to a discharge end of the barrel, said adaptor including a body portion with a socket therein for receiving a portion of the barrel and that terminates in the discharge end of the barrel, the socket having an opening at one end thereof in alignment with an opening through which the pin is discharged from the barrel, means for holding the adaptor on the end of the barrel with the adaptor rotatable about the axis of the barrel, said means including inter-engaging parts of the adaptor and the barrel, one of said parts being a circumferentially recessed portion of an outside surface of the barrel concentric with the axis of the barrel and the other being a retaining element that extends through a portion of the body of the adaptor at a location to project into the circumferentially recessed portion in the outside surface of the barrel and that projects into the recess, a surface on the end of the adaptor that is remote from the barrel, and releasable means for holding a clip on said surface with the clip extending across said opening in the barrel and in position to be pinned to said surface adjacent to the discharge end of the barrel upon operation of the percussion tool.

2. The adaptor described in claim 1 characterized by the retaining element being a pin at a location to hold the adaptor secured to the barrel and rotatable through 360°.

3. The adaptor described in claim 1 characterized by the releasible means for holding a clip on the adaptor including a fixed jaw on one side of said end face of the adaptor, and another jaw that moves toward and from the fixed jaw to grip and release the clip, both of said jaws having faces that taper toward one another as they extend away from the end of the barrel of the tool, said jaws being spaced to hold a clip, of the size with which the adaptor is intended to be used, in a generally centered position adjacent to a pointed pin held in the tool by a releasable clip in the barrel of the tool and directly under the clip for piercing the clip when the pin is projected into contact with the clip by a powder driven ram in the barrel of the tool.

4. The adaptor described in claim 3 characterized by the tapered jaws extending away from said surface of the adaptor on which the clip is held for a distance slightly greater than the thickness of the clip.

5. The adaptor described in claim 3 characterized by the tapered jaws forming a channel that extends all the way to one side of the adaptor so that a clip on the adaptor can extend beyond the adaptor.

6. An adaptor for a percussion tool that has a barrel from which a pin is driven into a surface adjacent to a discharge end of the barrel, said adaptor including a body portion with a socket therein for receiving a portion of the barrel and that terminates in the discharge end of the barrel, the socket having an opening at one end thereof in alignment with an opening through which the pin is discharged from the barrel, means for holding the adaptor on the end of the barrel, a surface on the end of the adaptor that is remote from the barrel, and releasable means for holding a clip on said surface with the clip extending across said opening in the barrel and in position to be pinned to said surface adjacent to the discharge end of the barrel upon operation of the percussion tool, and characterized by the releasable means for holding the clip in position on the adaptor including a lever connected with the adaptor by a movable connection on which the lever is angularly movable with respect to the adaptor, and a jaw connected with one end of the lever in position to move into and out of contact with a clip on said surface on the end of the adaptor.

7. The adaptor described in claim 6 characterized by the lever having lugs on both sides thereof in position to engage a supporting bearing on which the lever has angular movement to engage and disengage with the clip.

8. The adaptor described in claim 7 characterized by the supporting bearing comprising end portions of a retaining pin that constitutes the means for holding the adaptor on the end of the barrel with the adaptor rotatable about the axis of the barrel.

9. The adaptor described in claim 7 characterized by the supporting bearing being intermediate the ends of the adaptor, and resilient means for urging the jaw into contact with the clip, said resilient means contacting the lever at a location on the side of the bearing remote from the jaw.

10. The adaptor described in claim 9 characterized by said resilient means being a coil compression spring, a socket in the adaptor in which one end of the spring is held, the other end of the spring contacting with the surface of the lever at a location to rock the lever angularly in a direction to engage a clip supported by said adaptor.

11. The adaptor described in claim 10 characterized by the lever having a stop surface that engages a part of the adaptor to stop further movement of the lever when the lever moves beyond the position at which it engages a clip on the adaptor when there is any clip on the adaptor in position to be gripped by the lever, said stop arresting movement of the lever before the lever moves far enough for the coil compression spring to drop out of its socket in the adaptor.

* * * * *